United States Patent [19]

Livengood

[11] 4,039,085

[45] Aug. 2, 1977

[54] CRANE WITH A PIVOTED BOOM AND A FLOAT VALVE THEREFOR

[75] Inventor: Lynn W. Livengood, Chattanooga, Tenn.

[73] Assignee: Koehring Company, Milwaukee, Wis.

[21] Appl. No.: 694,832

[22] Filed: June 10, 1976

[51] Int. Cl.[2] ..... B66G 23/62

[52] U.S. Cl. ..... 212/46 R; 212/8 R; 91/420; 91/464

[58] Field of Search ..... 212/28, 46 R, 8 R; 91/464, 439, 420

[56] References Cited

U.S. PATENT DOCUMENTS

| | | | |
|---|---|---|---|
| 3,083,837 | 4/1963 | Jones et al. | 212/46 R |
| 3,426,916 | 2/1969 | Novotny | 212/46 R |
| 3,613,508 | 10/1971 | Krehbiel | 91/420 |
| 3,908,515 | 9/1975 | Johnson | 91/464 X |
| 3,924,656 | 12/1975 | Hanser et al. | 91/464 X |

FOREIGN PATENT DOCUMENTS

| | | | |
|---|---|---|---|
| 1,214,066 | 4/1960 | France | 212/46 R |

*Primary Examiner*—Albert J. Makay
*Assistant Examiner*—R. B. Johnson
*Attorney, Agent, or Firm*—Andrew J. Beck

[57] ABSTRACT

A crane is disclosed having hydraulic means for boom elevation control which is provided with a load-holding check valve and a float valve interposed therebetween. The float valve is intentionally operable to a float position establishing fluid communication between opposed actuating chambers of the hydraulic means during crane transportation. The float valve includes a preferred position which does not interfere with conventional operation of combination of the hydraulic means and the load holding valve. The float valve is intentionally actuated to the float position by manually connecting a releasable coupling to a pilot pressure source. During crane operation, the releasable coupling is connected to a discharge hydraulic circuit that disables the float valve to prevent its inadvertent operation. The float valve is operable during crane transportation to allow the boom to move vertically in response to perturbations of a boom supporting dolly.

13 Claims, 5 Drawing Figures

CRANE WITH A PIVOTED BOOM AND A FLOAT VALVE THEREFOR

BACKGROUND OF THE INVENTION

This invention relates to a crane having a boom with hydraulic elevation control. More specifically, this invention is concerned with a crane having a hydraulically controlled boom that is further provided with a load-holding check valve to prevent inadvertent loss of actuating hydraulic pressure during crane operation.

With the increased lifting capacity in many large mobile cranes, a problem has arisen during crane transportation from one job site to another: for many states have enacted highway use restrictions. Often, the restrictions limit the weight that may legally be carried on wheels traversing the state's highways. As a result, some very large cranes must be disassembled into subassemblies for transportation.

With some cranes, however, it has been found that a wheeled dolly supporting the end of the boom provides an alternative approach to crane disassembly. In this manner, the actual weight carried by the rear wheels of the mobile crane is reduced by that portion of the boom weight supported by the dolly. Typically, the dolly is attached to the carrier of the mobile crane and is pulled thereby in a tandem fashion.

Mobile cranes are well known which have one or more double-acting hydraulic cylinders or the like to control boom elevation. In more recent times, federal safety regulations have required that the hydraulic boom elevation cylinders be provided with a corresponding load-holding check valve. The load-holding check valve must be connected to the corresponding hydraulic cylinder such that an accidental failure of pressure generating apparatus or hydraulic conduits leading to the hydraulic cylinder will not result in a loss of actuating pressure in the hydraulic cylinder.

The presence of a load-holding check valve in a boom elevation control system effectively prevents the free flow of hydraulic fluid from one end of the double-acting hydraulic cylinder to the other. Accordingly, the boom itself is essentially rigidly fixed to the crane.

This rigid connection creates a substantial problem during transportation of the crane. For example, a relatively small elevational change at the dolly supported end of the boom during travel at highway speeds of, for example 45 miles per hour can induce relatively large impulsive loads and concomitantly high stresses in the hydraulic system.

Such repetitive impulsive loads are deleterious and may cause fatigue problems as well as various other damage and premature failures in affected components. It is, of course, highly desirable to obviate problems of the type noted. Moreover, it would be advantageous to have a means facilitating compliance with highway use statutes which conforms to crane safety requirements while avoiding substantial disassembly of the crane during transportation.

Accordingly, the need continues to exist for an effective means to use a load-holding valve and a hydraulic boom elevation system in a crane while permitting the crane to be readily transported over highways within the allowable statutory weight restriction.

SUMMARY OF THE INVENTION

A device which is intended to overcome problems of the type discussed above preferably includes a float valve means disposed between the load-holding check valve and a hydraulic boom elevation cylinder. The float valve means preferably is directly connected to a mounting pad on a hydraulic cylinder and has the load-holding check valve mounted directly thereon to define a valve stack. In this manner, it is possible to avoid any hydraulic conduits which may be subject to inadvertent failure between the check valve and the cylinder itself.

The float valve means is preferably designed such that it does not interfere with the normal operation of the boom elevation control system during boom raising and lowering functions. However, the float valve is designed such that it may be intentionally actuated to override the load-holding valve function when the crane is being transported between job sites.

The float valve means includes a valve body means having actuator fluid passage means which provide fluid communication directly between the load-holding check valve and actuating chambers of the hydraulic cylinder. In this manner, the float valve means and check valve assembly without interference.

The valve body means is also provided with a cross-over passage means interconnecting the two actuating fluid passage means and having a valve seat. A valve spool means is slidably disposed within the cross-over passage means and has a valve protrusion that is operable to seat on the valve seat of the cross-over passage means to prevent fluid flow through the cross-over passage means.

With the valve protrusion seated, the cross-over passage does not affect normal or conventional operation of the hydraulic cylinder. However, when the valve spool means is translated to a second position such that the valve protrusion is not juxtaposed to the valve seat, fluid communication is established through the cross-over passage means between the actuator fluid passages, and the effect of the load-holding valve on the hydraulic cylinder is bypassed. Accordingly, communication is established between opposed actuating chambers of the hydraulic cylinder and the end of the boom is free to float vertically with respect to the crane itself.

To effect fail-safe operation of the float valve means during operation of the boom elevation system, the float valve means is provided with suitable valve biasing means that urges the valve spool means to the first position where the valve protrusion is seated in sealing relationship on the valve seat of the cross-over passage means. Thus, the first or preferred position of the valve spool means is such that the float valve means does not in any way affect the combination of the hydraulic cylinder and the load-holding check valve.

An actuator means may also be provided to override the biasing means and translate the valve spool within the crossover passage means to the second position to effect the floating condition of the hydraulic cylinder. The actuator means may comprise a fluid pressure piston which is operable when connected to a source of hydraulic pressure.

To accomplish connection with the pressure source, a conduit may be provided which communicates with the float valve means at one end and has a releasable connector assembly at the other end. The connector assembly is ordinarily connected to a discharge hydraulic circuit such as a hydraulic supply tank. When it is desired to actuate the actuator means, the releasable connector is disconnected from the discharge circuit and connected to a hydraulic charging circuit. Thus, an intentional physical act is required to effect the float configuration for the boom elevating cylinder. If the hydraulic charging circuit is not disconnected and the actuating pressure released, it is impossible to raise the boom elevating cylinder with the normal operating controls.

The float valve of the present invention may also include compensatory fluid means for supplying needed hydraulic fluid and for receiving surplus hydraulic fluid to account for the different volumes on opposite sides of the double-acting boom elevation cylinder. The compensatory means communicates with the cross-over passage and is arranged such that it is operatively connected with the cross-over passage when the valve protrusion is not in contact with the valve seat.

BRIEF DESCRIPTION OF THE DRAWINGS

The operation and construction of a float valve constructed in accordance with the present invention will best be understood from this specification and the accompanying drawings wherein like reference numerals have been applied to like elements and wherein.

DESCRIPTION OF A PREFERRED EMBODIMENT

Figure 1:
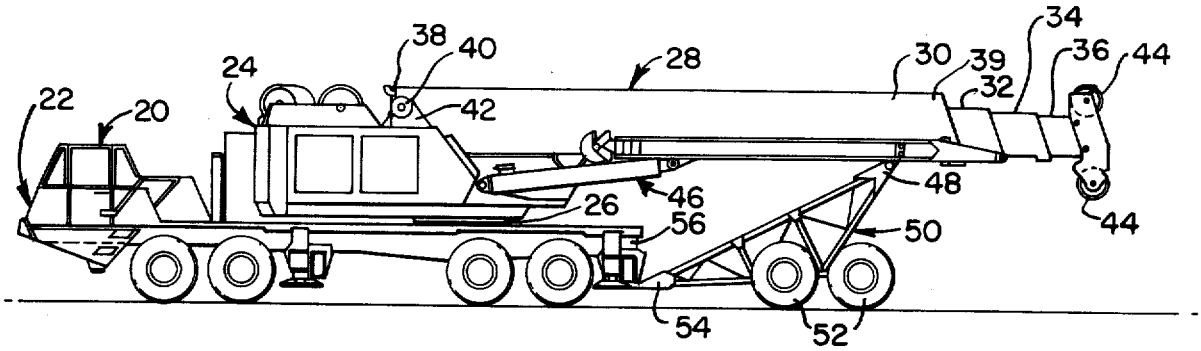
FIG. 1 is a side elevation of a mobile crane during highway transportation having a dolly-supported boom.

Turning now to FIG. 1, a mobile crane 20 is illustrated which includes a pneumatically wheeled carrier portion 22. A superstructure portion 24 is rotatably mounted on the carrier portion 22 by means of a slewing ring 26.

The superstructure 24 includes boom means 28 having a plurality of telescopically arranged sections 30, 32, 34, 36. The outermost boom section 30 is pivotally mounted at one end 38 to the superstructure 24 by means of a suitable generally horizontal pivot 40. The pivot 40 is carried by a clevis 42 attached to an upper portion of the superstructure 24.

Suitable connection cable sheaves 44 are provided at the tip of the innermost boom section 36 to provide support for a suitable flexible wire rope or the like. The wire rope may be directly used to hoist objects or may support a tackle assembly that in turn engages an object.

The boom means 28 is provided with a hydraulic cylinder means or hydraulic boom elevation control means 46 which is pivotally connected at one end to the superstructure 24 and is pivotally connected at a second end to the boom section 30 at a position intermediate the ends thereof and spaced from the pivot 40. The hydraulic boom elevation control means 46 may include a hydraulic cylinder of the double-acting piston type to provide both powered lifting of the boom means 28 and powered lowering motion of the boom means 28.

During transportation between job sites, a second end 39 of the first boom section 30 is vertically supported by the upper portion 48 of a dolly 50. The upper portion 48 underlies the boom means 28 at a position adjacent to the second end 39 of the outermost section 30.

The dolly 50 may include a plurality of ground engaging pneumatic wheels 52 and a generally open truss-like framework, as illustrated, having a triangular elevation. A tongue portion 54 of the dolly 50 is adapted for pivotal connection about horizontal and vertical axes to a rear portion 56 of the carrier 22. The tandem relationship of the dolly 50 and the carrier 22 enables turns to be negotiated without sidewise dragging of the wheels 52. Moreover, the dolly 50 can move vertically relative to the carrier 22 when traversing vertical curves or perturbations in a highway.

Figure 2:
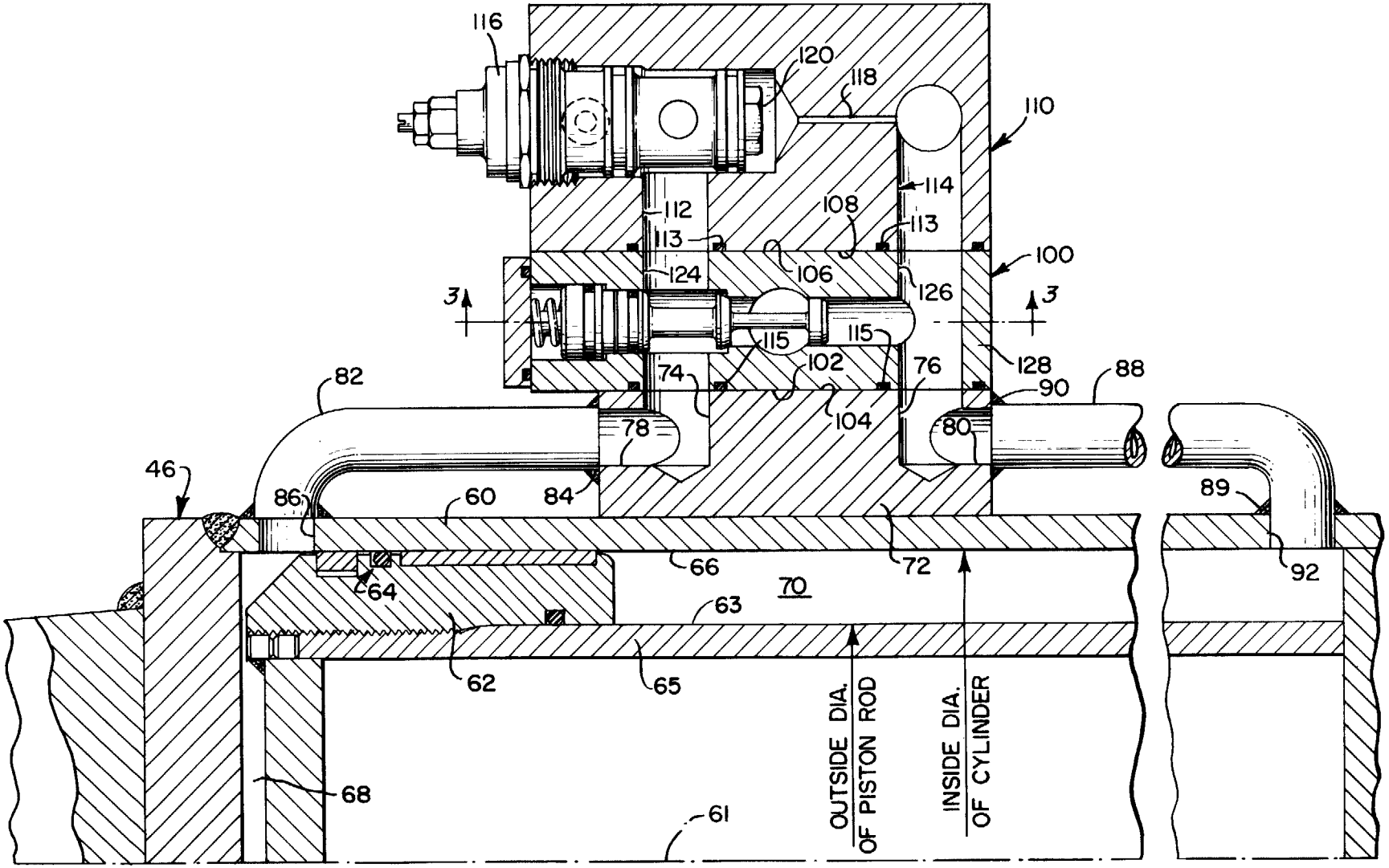
FIG. 2 is an enlarged view in partial cross-section of a boom elevation control cylinder having a load-holding check valve stacked on a float valve according to the present invention.

With reference now to FIG. 2, it will be seen that the boom elevation control means 46 includes a double-acting hydraulic cylinder 60 having a double-acting piston 62 reciprocably mounted therein. The piston 62 is provided with suitable seals 64 to sub-divide the internal chamber 66 of the cylinder 60 into a first actuating chamber 68 and a second actuating chamber 70. It will be apparent from an inspection of FIG. 2 that the cross-sectional area of the first actuating chamber 68 is essentially the area circumscribed by the inside wall of the cylinder 60. The cross-sectional area of the second actuating chamber 70 is annular with an outside circumference circumscribed by the inside wall of the cylinder 60 and an inside circumference defined by a surface 63 of the piston rod 65. Thus there is a disparity in the cross-sectional area of the chambers 68, 70.

Accordingly, sliding movement of the piston 62 to the right as illustrated in FIG. 2 through a given linear displacement will require a greater volume of actuating fluid to enter the first actuating chamber 68 than the volume of fluid displaced from the second actuating chamber 70. In addition, it will also be apparent that the movement of the piston 62 to the left of FIG. 2 will displace a greater volume of hydraulic fluid from the first actuating chamber 68 than is introduced into the second actuating chamber 70. Such volumetric disparities must be compensated in a float valve as will be seen hereinafter.

The cylinder 60 is provided with a mounting pad 72 on an external cylindrical surface thereof. The mounting pad 72 is provided with a pair of ports 74, 76 which are generally perpendicular with respect to the longitudinal axis 61 of the cylinder 60 and extend partially through the mounting pad 72. A pair of intersecting bores 78, 80 are provided in the mounting pad 72 with their axes generally parallel to the longitudinal axis 61 of the cylinder 60. Each intersecting bore 78, 80 communicates with a corresponding one of the first ports 74, 76 to define non-communicating fluid channels through the mounting pad 72.

The bore 78 is in fluid communication with one end of a metal conduit 82 which is suitably welded to the mounting pad 72 at 84 to prevent loss of fluid pressure and leakage. The second end of the conduit 82 is suitably welded to the cylinder 60 in generally radial alignment with a generally radial port 86 which communicates with the first actuating chamber 68 adjacent an endwall of the cylinder 60.

The second bore 80 is in fluid communication with one end of a second metal conduit 88 which may be welded to the mounting pad 72 at 90 to prevent fluid leakage and pressure loss therefrom. The second end of the conduit 88 is in generally radial alignment with and welded at 89 to a second port 92 provided at the second end of the cylinder 60. The second port 92 is in fluid communication with the second actuating chamber 70.

Mounted directly on the mounting pad 72 is a float valve means 100 constructed in accordance with the present invention. The float valve means 100 has a first generally planar surface 102 which is mounted on a corresponding generally planar surface 104 of the mounting pad 72. A second generally planar surface 106 of the float valve means 100 is substantially parallel to the first generally planar surface 102 and has a planar surface 108 of a load-holding check valve means 110 mounted directly thereon. Thus, the float valve 100 is interposed between the load-holding check valve means 110 and the mounting pad 72 carried by the boom elevation control means 46.

The load-holding check valve means 110 (FIG. 2) is conventional and includes a first actuating fluid passage 112 through which hydraulic fluid passes to and from the first actuating chamber 68 of the boom elevation control means 46. The check valve means 110 is also provided with a second actuating fluid channel 114 through which actuating fluid passes to and from the second actuating chamber 70 of the boom elevation control means 46.

During extension of the boom elevation control means 46, pressurized fluid from an external source is admitted through a pilot operated check valve 116 in the first actuating fluid passage 112. The check valve 116 normally prevents fluid from passing from the passage 112 toward the external source. Pressurized fluid from the passage 112 then enters first actuating chamber 68. Simultaneously, hydraulic fluid leaves the second actuating chamber 70 through the port 92, conduit 88, bore 80, port 76 and the passage 114 from which it is vented to a hydraulic reservoir.

During retraction of the boom elevation control means 46, hydraulic pressure is introduced from the external source through the second actuating fluid passage 114 and ultimately enters the second actuating chamber 70. In addition, the pressure enters a pilot pressure port 118 communicating with the passage 114 and a pressure responsive end 120 of the check valve 116. Fluid pressure acting on the end 120 of the check valve means 116 shifts the check valve means 116 to a flow permitting configuration so that hydraulic fluid may be expelled from the second actuating chamber 68 through the port 86, the conduit 82, the bore 78, the port 74, the passage 112, and the check valve 116 back to a tank or reservoir.

With continued reference to FIG. 2, the float valve means 100 positioned between the check valve means 110 and the mounting pad 72 will now be described. The float valve means 100 is provided with a pair of actuating fluid passages or channels 124, 126 which extend between the generally planar surfaces 102, 106 of a valve body means 128. The channels 124, 126 provide fluid communication between the corresponding actuating passages 112, 114 of the check valve means 110 and the generally radially extending ports 74, 76 of the mounting pad 72. The actuating fluid passages 124, 126 have a relatively large diameter to provide a relatively low restriction to hydraulic fluid passing therethrough. Accordingly, the float valve means 100 has little discernable influence on conventional operation of the assembly of the load-holding check valve means 110 and the boom elevation control means 46.

To inhibit leakage and pressure losses between the stack consisting of the mounting pad 72, the float valve means 100 and the check valve means 110, suitable conventional annular seals 113 may be provided around the aligned passages 112, 124 and 114, 126 between the abutting planar surfaces 106, 108. Similarly, suitable conventional annular seals 115 may be provided between aligned passages and ports 124, 74 and 126, 76 between abutting planar surfaces 102, 104.

Figure 3:
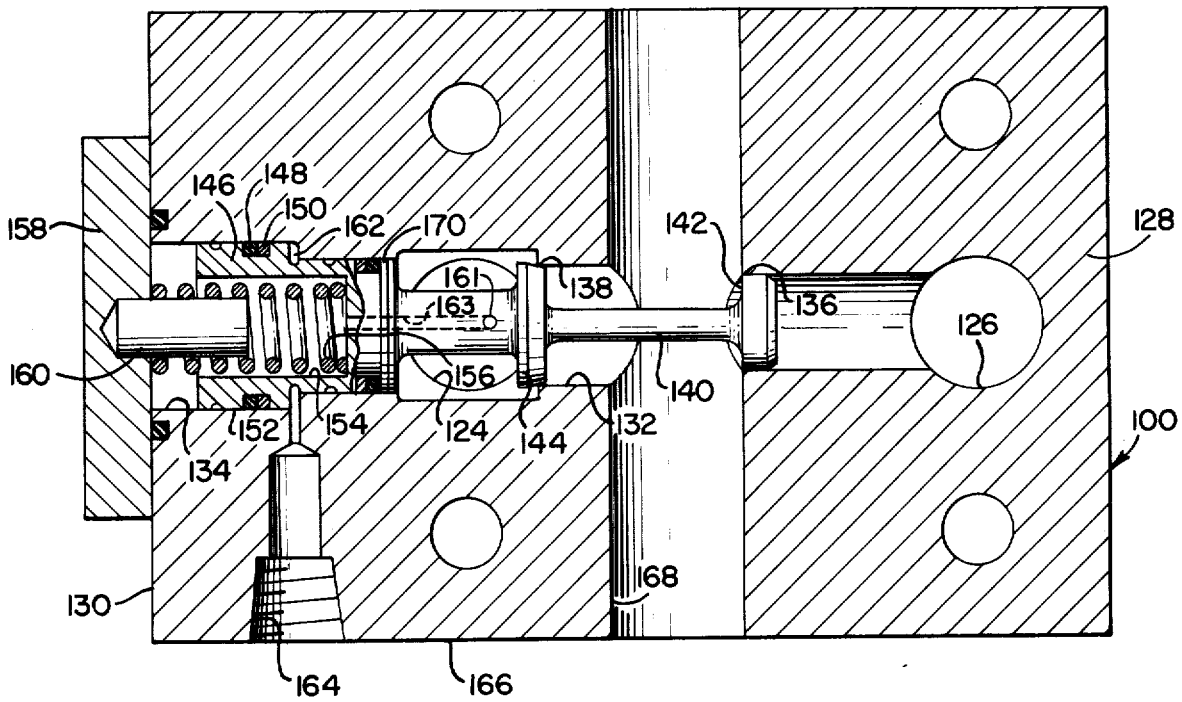
FIG. 3 is a view in partial cross-section taken along the line 3—3 of the FIG. 2 with the float valve in a preferred position.

Turning now to FIG. 3, the float valve means 100 is illustrated in greater detail. Extending from one end surface 130 of the valve body means 128 is a cross-over passage or channel 132. The channel 132 has an axis that is generally parallel to the longitudinal axis 61 (see FIG. 2) of the hydraulic cylinder 60 and which intersects the axes of the actuating fluid channels 124, 126. The channel 132 (see FIG. 3) is provided with a counterbore 134 at its end adjacent the end surface 130. By extending between the first and second actuating fluid channels 124, 126 the cross-over channel 132 can establish fluid communication therebetween.

Preferably the channel 132 includes a bore 136 and a valve seat 138 which are spaced apart from one another longitudinally along the cross-over passage. The bore 136 and valve seat 138 are positioned between the channels 124, 126.

Slidably mounted for longitudinal movement within the cross-over channel 132 is a valve spool means 140. The spool means 140 has a first valve protrusion or member 142 at an end thereof. The first valve protrusion 142 may be generally circular in cross-section and is adapted to move partially into the bore 136 and into fluid sealing relationship therewith.

The valve spool means 140 also includes a second valve protrusion or member 144 which is adapted to move into fluid sealing relationship with the valve seat 138. The first and second valve protrusions 142, 144 are spaced apart axially along the spool means 140 by a distance corresponding to the spacing between valve seat 138 and the bore 136.

The second end of the valve spool assembly 140 extends through the first actuating fluid channel 124 and into the counterbore 134. The second end includes an enlarged radially outwardly extending piston end portion 146 which is slidably received within the counterbore portion 134 of the cross-over channel 132. The piston end 146 is provided with suitable circumferential seals 148 and back-up rings 150 that effect a fluid seal between the peripheral cylindrical surface 152 and the counterbore 134.

The piston end 146 also has a coaxially extending generally cylindrical recess 154 which is adapted to receive a compression spring 156. One end of the spring 156 abuts the valve spool means 140 within the recess 154; the second end abuts a cover plate 158 that is attached to the end surface 130. The cover plate 158 is provided with a generally cylindrical pin 160 which is coaxially disposed within the counterbore 134 and serves as a guide for the spring 156.

The spring 156 comprises a resilient biasing means for urging the valve spool means 140 into a first, flow inhibiting position where the radial protrusions 142, 144 effect fluid seals with the corresponding bore 136 and the valve seat 138. The valve spool means 140 includes a generally radial port 161 between the second radial protrusion and the piston end 146. The port 161 communicates with a longitudinal channel 163 which, in turn communicates with the cylindrical recess 154. Fluid pressure in the passage 124 communicates through the port 161 and the channel 163 with the recess 154 where the fluid pressure aids the spring 156 to effect the fluid sealing relationship of the protrusions 142, 144 with the respective bore 136 and the valve seat 138.

From FIG. 3 is will be noted that during boom lowering, actuating hydraulic pressure will act on the cross-sectional area of the valve protrusion 142 and cause a longitudinal force opposing the longitudinal force exerted by the spring 156. Accordingly, the spring 156 must be selected such that it exerts a longitudinal force greater than can be experienced on the protrusion 142 from actuating fluid pressure.

The piston end 146 and the counter-bore 134 cooperate to define an annular piston actuating chamber 162 surrounding the spool means 140 and communicating with a pilot pressure port 164 in one side surface 166 of the valve body means 128. The chamber 162 provides a means for actuating the valve spool means 140 to shift it against the bias of spring 156 to a second, flow permitting position.

With continued reference to FIG. 3, a compensatory fluid means including a passage 168 is provided to accommodate the disparate volumetric flows of fluid accompanying displacement of the piston 62 (see FIG. 2). The passage 168 (see FIG. 3) extends through the valve body means 128 at a location spaced from each of the actuating fluid passages 124, 126. The compensatory passage 168 intersects and communicates with the cross-over channel 132 at a position between the bore 136 and the valve seat 138. With the valve spool means 140 in the position illustrated by FIG. 3, fluid communication is blocked between the actuating fluid channels 124, 126 themselves, as well as between each actuating fluid channel 124, 126 and the surplus fluid channel 168.

Figure 4:
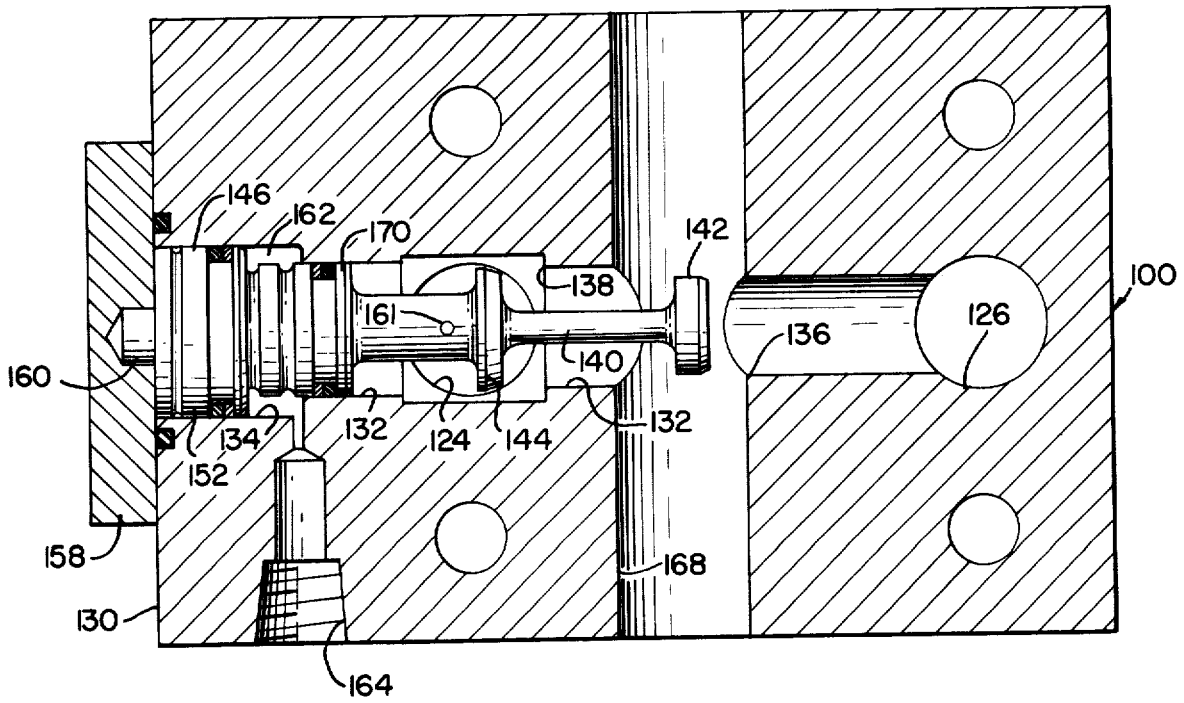
FIG. 4 is a view similar to FIG. 3 with the float valve in the float position.

Turning now to FIG. 4, the float valve assembly 100 is illustrated with the valve spool means 140 in the second position. The second position of 140 is effected by introducing fluid pressure through the port 164 to the piston actuating chamber 162. The fluid pressure acts on a radial piston surface and exerts a longitudinally-directed force in the direction opposite to the force exerted by the biasing spring 156. When sufficiently high hydraulic pressure is applied to the port 164 to overcome the spring bias, the valve spool means 140 moves rearwardly in the bore 132 toward the end surface 130 such that the valve protrusions 142, 144 are retracted from fluid sealing relationship with the respective valve seat 138 and the bore 136. Thus, fluid communication is established between the first and second actuating fluid channels 124, 126 and the compensatory fluid channel 168. The channel 168 may, for example, be connected to the hydraulic fluid reservoir so that an ample supply of fluid can be furnished as needed and an excessive volume of fluid can be accepted.

It will be noted that the position of the valve spool assembly 140 coaxially within the cross-over channel 132 is maintained by the cooperation between the external cylindrical surface 152 of the piston end 146 and the counter-bore 134 as well as the cooperation between the external surface 170 of the valve spool and the bore 132.

The cross-over bore 132 may be provided with a larger cross-sectional diameter in the portion between the first actuating fluid channel 124 and the compensatory fluid channel 168 than the cross-sectional diameter of the bore 136 between the compensatory fluid channel 168 and the second actuating fluid channel 126. The larger diameter portion thus has a larger cross-sectional area that, in part, compensates for the presence of the shank portion of the valve spool means 140 extending between the first and second valve protrusions 142, 144.

In addition, the channel 124 communicates with the first actuating fluid chamber 68 (see FIG. 2) of the boom elevation control means 46. Accordingly, by virtue of the varying areas between the first and second actuating fluid chambers 68, 70, the passage 124 must convey a larger volume of fluid than the passage 126 for the same axial displacement of the piston 62.

Figure 5:
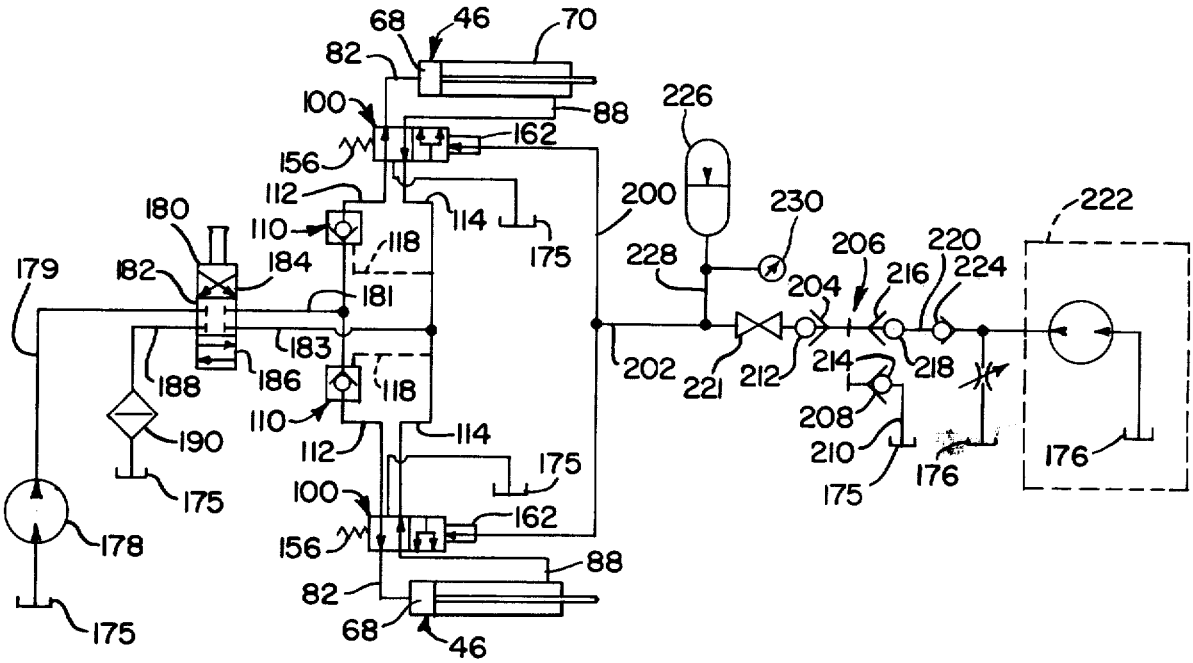
FIG. 5 is a schematic illustration of a hydraulic boom elevation control system circuit which describes the operation of the present invention.

Turning now to FIG. 5, the interaction of the float valve means 100 with other hydraulic components of the crane can be more readily visualized. In FIG. 5, two boom elevation control means 46 and the associated float valves and load-holding check valves are depicted in operative relation with a single boom control valve 180. The crane has a suitable reservoir 175 for the storage of hydraulic fluid used in the hydraulic system. The reservoir 175 communicates with a pump 178 which pressurizes hydraulic fluid to be used in the hydraulic boom elevation control means 46.

From the pump 178, the pressurized hydraulic fluid communicates via a conduit 179 to a boom control valve 180. The control valve includes a neutral position 182, a boom elevating cylinder extension position 186 and a boom elevating cylinder retraction position 184. The boom control valve 180 may be manually operated if desired. The boom control valve 180 also communicates with a conduit 188 that communicates with the reservoir 175 through a suitable filter 190.

With the boom control valve 180 in boom elevating cylinder extension position 186, pressurized hydraulic fluid is communicated directly to the load-holding check valves 110 by way of conduit 181. From the check valves 110, hydraulic fluid goes through the corresponding float valve means 100 and to the conduit 82 communicating with actuating chamber 68 of the corresponding double-acting boom elevation cylinder. Simultaneously, hydraulic fluid from the second actuating chamber 70 of the boom elevating cylinder returns through the conduit 88, the corresponding float valve means 100, the passage 114 and a conduit 183 to the boom elevation control valve 180. From valve 180, the exhausting fluid returns to the reservoir 175 through conduit 188.

When it is desired to retract the boom elevating control means 46, the boom control valve 180 is positioned with the second position 184 such that the pressurized fluid from the pump 178 communicates directly with the conduit 183, the corresponding passage 114, the corresponding float valve means 100, the conduit 88 and the second actuating chamber 70 of the boom elevating control means. Simultaneously, the fluid pressure passes through passage 118 of each check valve means 110 to shift the check valve into its check bypassing mode.

Fluid from the first actuating chamber 68 then may return through corresponding conduit 82, the corresponding float valve means 100, the passage 112, the corresponding check valve means 110, and conduit 181 to the control valve 180. From the control valve, the fluid returns to the reservoir 175 through the conduit 188.

From the foregoing discussion, it will be apparent that the float valve means 100 must be in the spring biased position in order to permit conventional operation of the boom elevation control means 46. Moreover, if the piston actuating chambers 162 are accidentally pressurized the float valve means 100 might assume the second position which allows the boom means to float.

Accordingly, each of the actuating chambers 162 is connected by means of conduit 200 having a branch conduit 202. One end of the branch conduit 202 includes a first end 204 of a releasable connector assembly 206. The first end 204 may be connected to one of two mating second ends 208, 216: the second end 208 communicates with an hydraulic discharge circuit; the second end 216 communicates with an hydraulic charging circuit.

The hydraulic discharge circuit includes a conduit 210 communicating with a reservoir 176 so that no hydraulic pressure can exist in the conduit 210. With the two ends 204, 208 of the releasable connector assembly 206 connected, conventional check valves 212, 214 of the connection are released so that free fluid communication is established between piston actuating chambers 162 and the reservoir 176.

When the connector assembly 206 is broken or released, the check valves 212, 214 become operative and prevent leakage and loss of the hydraulic fluid from the conduits 210, 202.

When it is desired to shift the float valve means 100 to the float position, hydraulic pressure must be admitted to the actuating chambers 162 to overcome the bias of the springs 156. Accordingly, the first end 204 of the releasable connector assembly is connected to the alternate second end 216 which has a suitable conventional check valve 218 therein.

With the first end 204 connected to the alternate second end 216, the check valves 212, 218 are released (see FIG. 5) and fluid communication is established between the branch conduit 202 and a conduit 220.

A suitable source 222 of hydraulic pressure communicates with the second end of the conduit 220. The source 222 may, for example, be the hydraulic circuit of the carrier or the supply pressure of another control such as the boom extension control.

Hydraulic pressure from the source passes through a suitable check valve 224 which prevents pressure in the conduits 220, 202, 200 and the actuating chamber 162 from being released without physical disconnection of the charging circuit once the float valve means has been actuated.

To compensate for some leakage of hydraulic fluid and loss of hydraulic pressure, an accumulator chamber 226 is provided on a branch conduit 228 of the conduit 202. A suitable pressure gauge 230 may be connected to the branch conduit 228 so that the crane operator can be apprised of the pressure existing in the conduit 220. In addition a suitable conventional shut-off valve 221 may be installed in the conduit 202 between the releasable connector 206 and the branch conduit 228. The shut-off valve 221 is operable to close off the accumulator 226 from the pressure source 222 after a prescribed pressure has been attained. In this manner, the connector assembly 206 will be in a non-pressurized portion of the circuit when the pressure source 222 is not operating.

Returning to FIG. 1, as the crane 20 is traveling at highway speeds, e.g. 45 m.p.h., vertical deflection of the boom end 39 is usually relatively small. Thus, the volume of fluid which must be transferred between the actuating chambers of double-acting cylinders is also small. However, the time interval for the transfer is ordinarily very brief.

For example, to cross a ten foot long gradual dip four inches deep at 45 m.p.h. would only require about 0.15 sec.; but the time for fluid transfer between cylinders would be about 0.075 sec. since the boom goes down first and is then raised as it leaves the dip. In a typical crane, the piston travel might be in the vicinity of 0.05 in. Thus, with a 10 in. I.D. cylinder having a 7.5 in. O.D. piston rod, fluid must flow to and from the first cylinder actuating chamber at about 13 gpm and to and from the second cylinder actuating chamber at about 5.5 gpm. The difference of about 7.5 gpm is accounted for by the compensatory fluid means.

Accordingly, it should now be apparent to those skilled in the art that there has been provided in accordance with the present invention a new and useful float valve for use in a crane having hydraulic boom elevation control means. Moreover, it will also be apparent to those skilled in the art that numerous modifications, variations, substitutions and equivalents for the elements as described may be made without departing from the spirit and scope of the invention. Therefore, it is expressly intended that all such modifications, variations, substitutions and equivalents that fall within the spirit and scope of the invention as defined in the appended claims be expressly embraced thereby.

What is claimed is:

1. In a crane having carrier means, boom means, hydraulic cylinder means for controlling elevation of the boom means, and load-holding check valve means for the hydraulic cylinder means to prevent accidental loss of actuating pressure, intentionally operable means for allowing the boom means to float during transportation of the crane between job sites comprising:

float valve means between the check valve means and the hydraulic cylinder means having actuating fluid channels extending between the check valve means and the hydraulic cylinder means, a cross-over channel means extending between the actuating fluid channels, and flow control means having a first condition operable to prevent fluid communication between the actuating fluid channels and a second condition operable to permit fluid communication between the actuating fluid channels; and means for causing the flow control means to assume the first condition during normal load lifting operations of said crane and being intentionally operable for causing the flow control means to assume the second condition to facilitate crane transporting operations.

2. The crane of claim 1 wherein:

the flow control means includes a valve spool slidably disposed in the cross-over channel means having a valve protrusion thereon which selectively cooperates with the cross-over channel means to permit and prohibit fluid communication through the cross-over channel means.

3. The crane of claim 2 wherein:

a compensatory fluid channel communicates with the cross-over channel means to supply and receive fluid as required by different cross-sectional areas of the actuating chambers of the hydraulic cylinder means;

the first valve protrusion selectively cooperates with the cross-over channel means between one actuating fluid channel and the compensatory fluid channel; and the valve spool has a second valve protrusion which selectively cooperates with the cross-over channel means between another actuating fluid channel and the compensatory fluid channel.

4. The crane of claim 2 wherein the means for causing includes;

biasing means acting on the valve spool operable to bias the valve spool and the valve protrusion to fluid communication prohibiting relationship with the cross-over channel means; and actuator means operable to move the valve spool to the second condition in the valve means, selectively override the biasing means to thereby establish fluid communication between the actuating fluid channels.

5. The crane of claim 4 wherein:

the cross-over channel means includes an extended portion that extends beyond one actuator channel and includes a counterbore at the one end of the cross-over channel;

the actuator means includes a piston carried by an end of the valve spool, disposed in the counterbore, cooperating with the counterbore to define a piston actuating chamber; and a fluid pressure port communicates with the piston actuating chamber through the valve body and is operable to receive pressurized fluid which actuates the piston.

6. In a crane having carrier means, boom means, hydraulic cylinder means for elevationally positioning the boom means, and load-holding check valve means, an improved valve means for allowing relative movement between the boom means and the carrier means during transportation comprising:

first fluid passage means between the load-holding valve means and one actuating chamber of the hydraulic means operable to convey pressurized fluid during raising of the boom means;

second fluid passage means between the load-holding valve means and a second actuating chamber of the hydraulic means operable to convey pressurized fluid during lowering of the boom means;

cross-over passage means for establishing fluid communication between the first and second fluid passage means;

flow control means movable between a flow inhibiting position in which flow through said cross-over passage means is blocked and a flow permitting position in which flow between said first and second fluid passage means through said cross-over passage means is permitted;

means for biasing said flow control means to said flow inhibiting position; and actuator means for moving said flow control means to said flow permitting position.

7. The crane of claim 6 having:

valve body means mounted between the load-holding valve means and the hydraulic cylinder means;

the first fluid passage means and the second fluid passage means being a first channel and a second channel, respectively, extending through the valve body means;

the cross-over passage means being a cross-over channel connecting the first and second channel in the valve body means; and fluid compensating means including a supply channel communicating with the cross-over channel between the first channel and the second channel being operable to furnish fluid to said cross-over channel during demand and operable to receive fluid from said cross-over channel during surplusage.

8. The crane of claim 7 wherein the flow control means includes a spool means and the biasing means comprises a resilient member which bears against one end of the spool means and against a closed end of the cross-over channel to generate a longitudinal force holding the spool means in the flow inhibiting position.

9. The crane of claim 7 wherein the actuator means includes:

a pilot pressure port in the valve body means communicating with the one end of the cross-over channel; and a fluid pressure responsive piston at an end of the flow control means in the one of the cross-over channel, cooperating with the cross-over channel end to define a piston actuating chamber that is operable to receive pressurized fluid from the pilot pressure port for translating the flow control means from the flow inhibiting position to the flow permitting position.

10. In a crane having a wheeled carrier, a superstructure, boom means, hydraulic cylinder means for boom elevation control, and load-holding check valve means, means for allowing the boom means to float during crane transportation, comprising:

a valve body having an end surface, a side surface, a first surface mounted on the hydraulic cylinder means, a second surface to which the load-holding check valve means is secured, first and second actuating fluid channels to provide fluid communication between the first and second surfaces, a cross-channel communicating with the first and second actuating channels and the end surface and having a counterbore at the end surface, and a compensatory fluid channel communicating with the cross-channel between the first and second actuating channels;

a valve stem slidable in the cross-channel, having a first valve protrusion between the first actuating fluid channel and the compensatory fluid channel, a second valve protrusion between the second actuating fluid channel and the compensatory fluid channel, and an enlarged end portion cooperating with the counterbore to define a fluid pressure chamber;

biasing means acting on the enlarged end portion to urge the valve protrusions into a flow inhibiting position;

a cover plate on the end surface of the valve body to seal the counterbore and retain the biasing means; and a pressure fluid port extending between the fluid pressure chamber and the side surface of the valve body and adapted to admit pressurized fluid to the chamber to move the valve stem against the biasing means and move the valve protrusions to a flow permitting position.

11. In a crane having carrier means, boom means, and hydraulic cylinder means for controlling elevation of the boom means, an improved valve stack for allowing relative movement between the boom means and the carrier means during crane transportation comprising:

first passage means communicating with a first actuating chamber of the hydraulic cylinder means and operable to convey pressurized fluid during raising of the boom means;

second passage means communicating with the second actuating chamber of the hydraulic cylinder means and operable to convey pressurized fluid during lowering of the boom means;

check valve means in the first passage means operable to prevent fluid flow from the first actuating chamber and having pilot means operable in response to fluid pressure in the second passage means to permit fluid flow from the first actuating chamber;

cross-over passage means for allowing fluid communication between the first and second actuating chamber; and flow control means movable between a flow inhibiting condition in which flow through the cross-over passage means is restricted and a flow allowing condition in which flow through the cross-over passage means is allowed.

12. The crane of claim 11 wherein:

the cross-over passage means communicates with the first and second fluid passage means; and the flow control means includes a valve spool with a valve member slidably mounted in the cross-over passage means and operable between a flow inhibiting position where the valve member inhibits fluid flow through the cross-over passage means and a flow allowing position where the valve member allows fluid flow through the cross-over passage means, biasing means acting on the valve spool and operable to urge the valve spool to the flow inhibiting position, and actuator means acting on the valve spool in opposition to the biasing means and operable to move the valve spool to the flow allowing position.

13. In a crane having carrier means, boom means, and hydraulic cylinder means for controlling elevation of the boom means, an improved valve stack for allowing relative movement between the boom means and the carrier means during crane transportation comprising:

body means operable for mounting on the hydraulic cylinder means and having a first channel communicating with a first actuating chamber of the hydraulic cylinder means and operable to convey fluid during raising and lowering of the boom means, a second channel communicating with a second actuating chamber of the hydraulic cylinder means and operable to convey fluid during raising and lowering of the boom means, a pilot passage extending between the first and second channels and communicating with the second channel, a cross-over channel communicating with the first and second channels, having a bore and a valve seat and operable to provide fluid communication between the first and second channels, and a compensatory fluid channel communicating with the cross-over channel at a location between the bore and the valve seat;

check valve means in the first channel operable to prevent fluid flow from the first actuating chamber, and being enabled by fluid pressure in the pilot passage to allow fluid flow from the first actuating chamber;

a valve spool having a first and a second valve protrusion spaced to correspond with the bore and the valve seat, slidably mounted in the cross-over channel between a first position in which each valve protrusion blocks fluid flow between a corresponding one of the first and second channels and the compensatory fluid channel and a second position in which flow is permitted between the first channel, the second channel and the compensatory fluid channel;

biasing means acting on the valve spool to urge the valve spool toward the first position; and actuator means operable to act on the valve spool in opposition to the biasing means and slide the valve spool to the second position.

* * * * *